US011160408B2

(12) United States Patent
Dorsey

(10) Patent No.: US 11,160,408 B2
(45) Date of Patent: Nov. 2, 2021

(54) ONE HAND AUTOMATIC CLOSING MAILBOX DOOR

(71) Applicant: Dean Loyd Dorsey, Medina, OH (US)

(72) Inventor: Dean Loyd Dorsey, Medina, OH (US)

( * ) Notice: Subject to any disclaimer, the term of this patent is extended or adjusted under 35 U.S.C. 154(b) by 0 days.

(21) Appl. No.: 15/977,528

(22) Filed: May 11, 2018

(65) Prior Publication Data

US 2020/0187692 A1 Jun. 18, 2020

Related U.S. Application Data

(60) Provisional application No. 62/515,619, filed on Jun. 6, 2017.

(51) Int. Cl.
*A47G 29/12* (2006.01)
*A47G 29/124* (2006.01)

(52) U.S. Cl.
CPC ..... *A47G 29/1209* (2013.01); *A47G 29/124* (2013.01)

(58) Field of Classification Search
CPC ..... A47G 29/1209; A47G 29/124; A47G 29/126; A47G 29/20; E06B 3/5072; E06B 3/50; E06B 3/509; E06B 3/5018; E06B 3/5063
USPC ..... 232/17, 19, 44, 45; 49/252; 220/532, 220/544
See application file for complete search history.

(56) References Cited

U.S. PATENT DOCUMENTS

| | | | | |
|---|---|---|---|---|
| 2,646,214 | A | 7/1953 | Cuplin | |
| 2,983,437 | A * | 5/1961 | Vandruff | A47G 29/12 232/17 |
| 3,143,286 | A | 8/1964 | Edge, Sr. | |
| 3,208,668 | A | 9/1965 | Dickins, Sr. | |
| 3,680,773 | A * | 8/1972 | Thompson | A47G 29/1209 232/17 |
| 3,767,111 | A | 10/1973 | Pattengill | |
| 4,413,770 | A | 11/1983 | Nye | |
| 4,723,702 | A | 2/1988 | Martin | |
| 4,848,605 | A | 7/1989 | Roberts, II | |
| 5,226,589 | A | 7/1993 | Davis | |
| 5,823,381 | A * | 10/1998 | Ashley | A47J 47/12 220/559 |
| 5,915,618 | A | 6/1999 | Gaudet | |
| 5,954,264 | A * | 9/1999 | Keller | A47G 29/1212 232/17 |
| 6,871,779 | B1 | 3/2005 | Whitney, Jr. | |
| 7,100,816 | B2 | 9/2006 | Offenbacher | |

(Continued)

*Primary Examiner* — William L Miller
(74) *Attorney, Agent, or Firm* — Pearne & Gordon LLP

(57) ABSTRACT

The present invention is an improved door for rural mailboxes, comprising of a frame and door rotating inward and vertically downward, or just vertically downward, allowing access to the mailbox for depositing or removal of mail in one motion. The frame and door made of wood, metal, plastic, rubber or other materials can be made as part of a new mailbox or made as a complete assembly to be added to an existing mailbox. The frame comprises channels with springs to hold door closed. The door having pins or one rod horizontally mounted on the door or held on each side of the door by collars and springs also used to hold the door closed or move the door vertically and inward as it moves toward the bottom of the mailbox. The pins extend into the channels on the frame.

20 Claims, 2 Drawing Sheets

(56) References Cited

U.S. PATENT DOCUMENTS

| | | | | |
|---|---|---|---|---|
| 7,178,717 | B1 * | 2/2007 | Lindell | A47G 29/1209 232/45 |
| 9,565,960 | B2 | 2/2017 | Gerard | |
| 2014/0346221 | A1 | 11/2014 | Pendergast | |
| 2017/0360235 | A1 | 12/2017 | Silko | |
| 2018/0306510 | A1 * | 10/2018 | Leppert | A23L 3/40 |

* cited by examiner 100
102
102a
102b
104
106
108
110
112
200
1
2

ONE HAND AUTOMATIC CLOSING MAILBOX DOOR

BACKGROUND

The classic mailbox has a door on a bottom hinge so that it swings outside the box when opened by pulling on the door handle. This maximizes available space in the box, but makes usage somewhat difficult and/or time consuming. Three separate actions are required, using one or both hands:

(1) Pull the door handle out of the latch and drop door to an open position hanging down.
(2) Reach inside to deposit mail in the box.
(3) Withdraw hand.
(4) Reach down to grasp the door, swing it up and push it into its latched closed position.

This can be done with one hand only if the mail is in the hand that opens the door or if the hand is pulled back to obtain the mail after opening the door (which requires more arm movements).

Self-closing mailbox doors are known, but suffer limitations in usability. For example the classic mailbox with an outward swinging door could be spring biased for self-closing, but then two hands are needed because a hand holding mail might be able to open the door, but then a second hand is needed to hold the door open long enough to allow the first hand to release the door handle and move around the open door edge to at least start reaching inside to deposit the mail.

The steps are now:

(1a) Use first hand to pull the door to an open position.
(1b) use second hand to hold it open.
(2) Use first hand to deposit mail inside the box.
(3) Withdraw first hand, as second hand releases the door for spring biased movement back to its closed position. All of the known prior art mailboxes with outward opening, self-closing doors generally require two hands to operate while delivering mail: one hand holds the door open while the other deposits the mail inside.

Examples include: U.S. Pat. No. 5,226,589 wherein a tension spring is stretched when the bottom hinged door is pulled open, and U.S. Pat. No. 2,646,214 which has a pivot at a lower corner and a torsion spring that causes the door to pivot back after it is rotated open. In another prior art example, one-handed operation may be possible if the spring biased or gravity assisted closure mailbox door opens by pushing it inward.

Carrier can hold the mail (meaning any kind of deliverable item(s) such as letters, newspaper, magazine, small parcels, etc. in one hand, push it into the mailbox and withdraw the hand allowing the door to close. The main problem is that the door uses up mailbox interior space when it is pushed in and will not close unless the mail is deposited deep enough into the box to leave room for the door to pivot closed, limiting the space for mail in the interior of the mailbox.

BRIEF SUMMARY

An object of the present invention is to provide a self-closing mailbox door that overcomes the deficiencies of the prior art while enabling quick and easy one-hand use.

The invention 100 with its door 102 that slides in addition to pivoting enables one handed self-closing use wherein the inward intrusion of the door may be made much smaller than prior art one handed self-closing doors that pivot inward. In general, the known prior art mailbox door either achieve self-closing without convenient one handed mail delivery, or achieve one handed delivery without efficient limitation of arm motions, or they might achieve one handed mail delivery with self-closing to reduce motions but sacrifice a significant portion of the mailbox interior space. There may be prior art that overcomes the latter limitation by not using an inward pivoting door, but most likely they will need to use much more complicated and expensive self closing mechanisms. The inventive self-closing mailbox door with a door panel on a sliding pivot, optionally spring-biased is an efficient and inexpensive new solution to a long standing problem. The invention by pivoting outward at the bottom of the channels (as needed) allows the mailbox to be filled without sacrificing any usable space.

DETAILED DESCRIPTION

Figures 1A, 1B, 1C, 2A, 2B, 2C, 3:
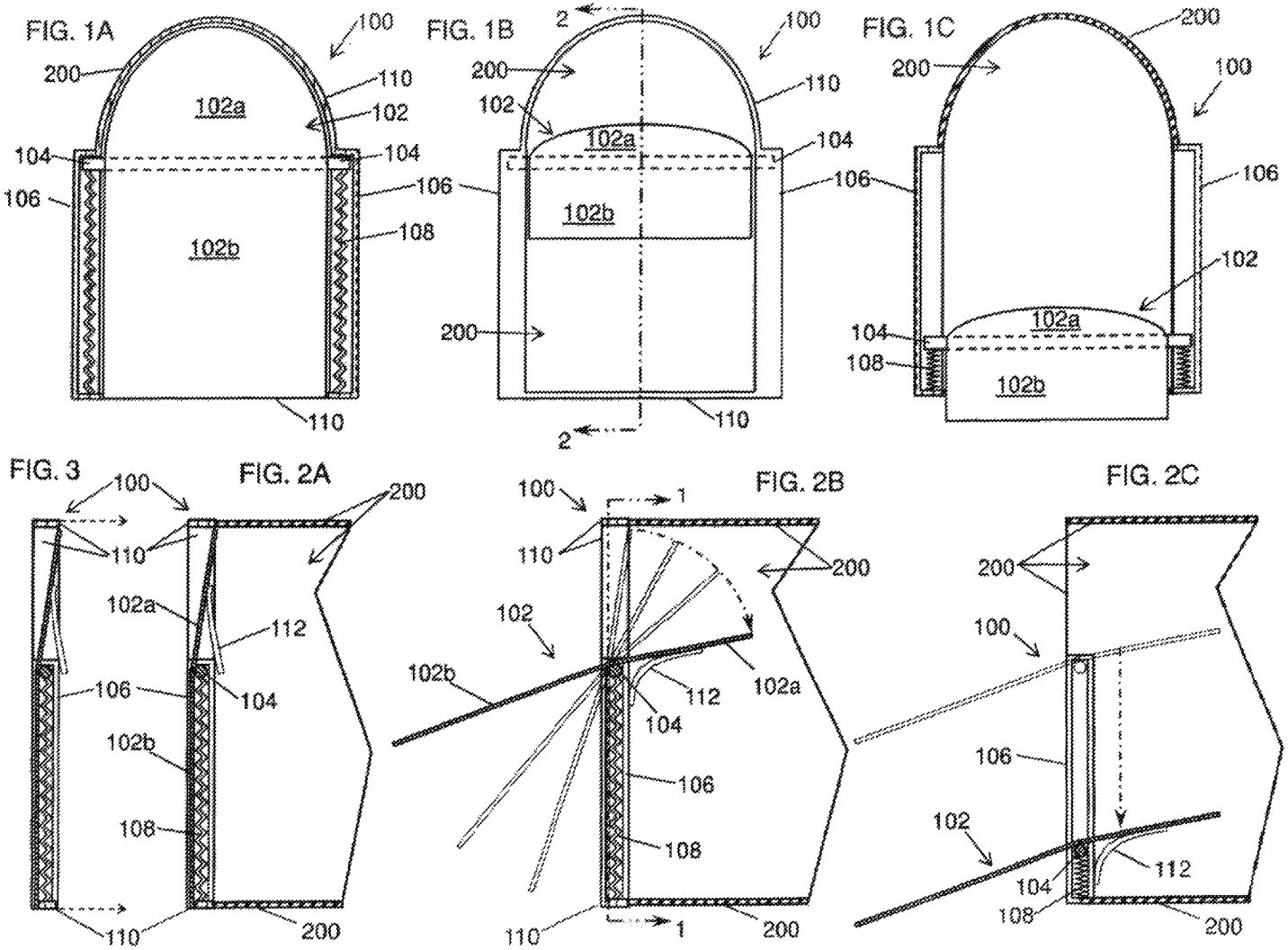
FIG. 1A is a sectional view of a door in a closed position according to an example embodiment of the present disclosure taken along section line 1-1 in FIG. 2B.
FIG. 1B shows the door of FIG. 1A open without being moved downward.
FIG. 1C shows the door of FIG. 1A completely open and down.
FIG. 2A is a sectional view of the door attached to a mailbox and shown in the closed position taken along section line 2-2 in FIG. 1B.
FIG. 2B shows the door of FIG. 2A open without being moved downward.
FIG. 2C shows the door of FIG. 2A pivoted inward and downward.
FIG. 3 shows the door of FIG. 2A detached from the mailbox.
Figure 4:
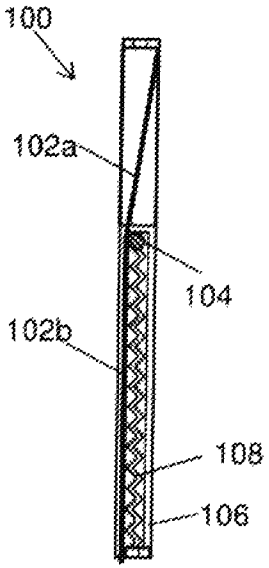
FIG. 4 is a view of an example self-closing door according to an example embodiment of the present disclosure.

Referring to FIGS. 1A-4C and 5: a self-closing door 100 for a mailbox 200 has a horizontal hinge pin/pivot 104 near the top of a vertically hanging door 102, and side tracks 106 holding both ends of the pin 104. The tracks restrict the pin and the attached door to pivoting on axis, as shown in FIG. 2B and to vertical movement along the track, as shown in FIG. 2C. A spring 108 biases the pin 104 up against the top of the track 106 where the door 102 is positioned to cover the mailbox opening. Gravity and optionally a spring, e.g., 112 bias the door to a closed position that covers the opening of box 200. The door 102 has a top part 102*a* above the pivot pin 104 and a bottom part 102*b* there below.

To operate the self closing door 100 for depositing mail into the box 200, the inventive method steps are:

1a holding mail in hand, push in on top part 102*a* of the door i.e., above the hinge pin 104, enough to be able to . . .
1b push downward and/or further inward to create a large enough opening above the door 102 to . . .
2a push the mail into the box 200 beyond the inward most end of the door top 102*a* (as in FIG. 4) where it will drop to be deposited in the box, then . . .
2b withdraw hand, such that the hand and arm maintain downward force on the door 102 by sliding on top of it, until . . .
3 hand is fully removed, which n::moves downward force and allows spring 108 to push the pivot 104 back to the closed position at top of the tracks 106. Simultaneously the door will pivot back to close the opening wherein the bottom part 102*b* is vertical and/or resting against the bottom edge of the box 200.

The dosing pivot action is caused by gravity pulling down on the door bottom 102*b* which is larger and heavier than the top part 102*a*. An optional spring 112 may be added in any fashion that will aid the closing pivot action. For example, FIGS. 2A-3 show a leaf spring with a cantilever attachment to the door 102 and a sliding contact against the track 106.

Figure 5:
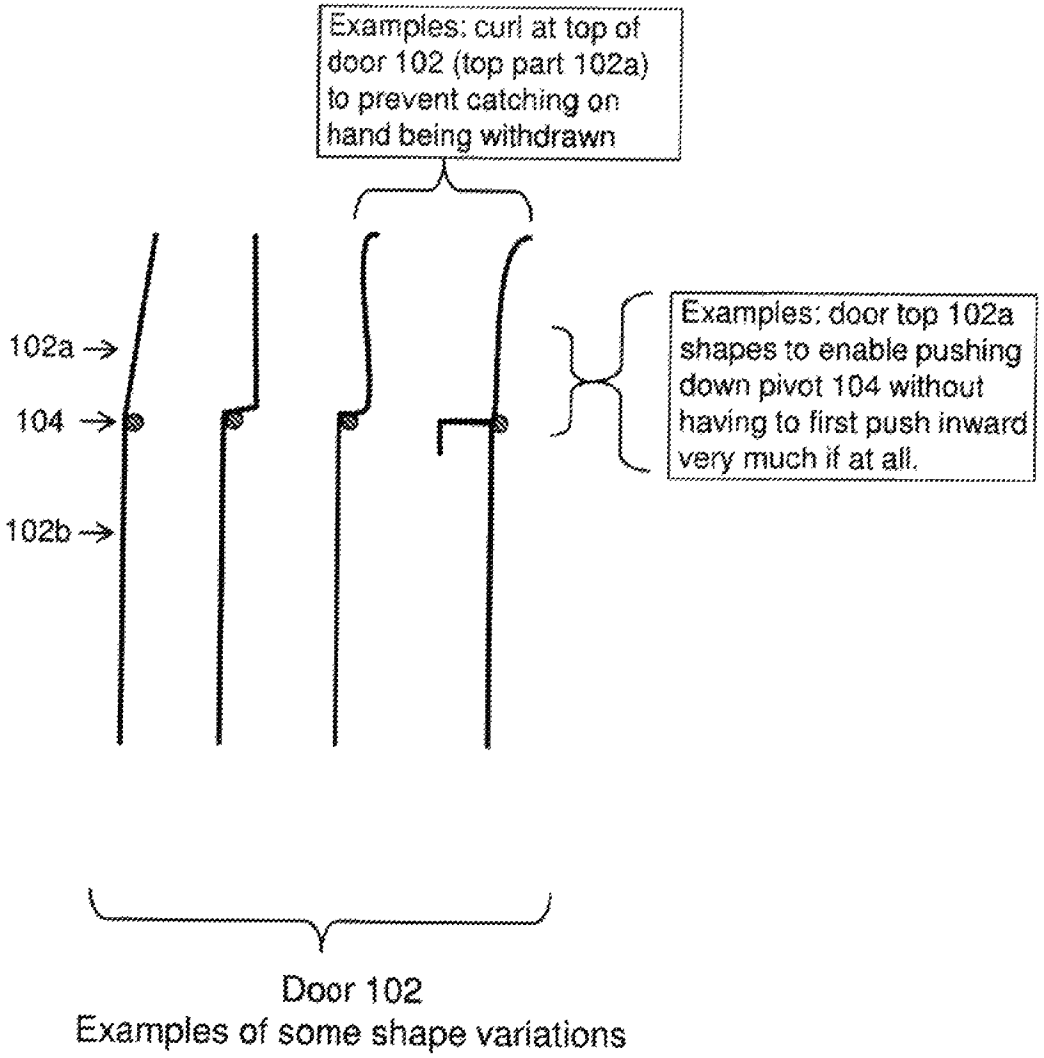
FIG. 5 illustrates various example alternative the door top profiles according to the present disclosure.

Referring also to FIG. 5, the door top 102*a* may be angled, curved, or otherwise offset inward to make it easier to push in above the pivot pin 104 enough to begin pushing downward without needing to push inward very far. The slanted profile shown in most drawings is only an example of any shape that will accomplish this objective. For example, another shape that accomplishes this is an outward projecting handle, also shown in FIG. 5.

Also shown in FIG. 5, the door top 102*a* profile may be curved/curled inward, optionally in addition to a different offset profile, and preferably with the most curled or rounded portion at the top edge in order to enable sliding the hand/arm without catching or scraping on the top edge, especially as the hand is withdrawn.

The door top 102*a* height HDa is less than the door bottom 102*b* height HDb, preferably much less. It should be minimized to maximize the length of the mail/package that will fit in the box, see FIG. 4.

As shown in FIG. 3, the self-closing door 100 may be a separate device that could be an add on for attaching to the front of any mailbox 200, e.g., replacing an original door 202. It is shown as an attachment in FIGS. 1A, 1B, 2A and 2B. This attachable version may have a band 110 surrounding the mailbox opening and holding everything together with the tracks 106 suitably positioned. Otherwise, as shown in FIGS. 1C and 2C, the tracks 106 may be built into/on/at the front edge of the mailbox opening.

Many variations of the basic design are contemplated, some being exemplified in the drawings e.g., FIG. 5 door examples, and all being within the scope of the invention provided they accomplish the inventive method of use described herein that incorporates a door panel on a sliding pivot. Certain embodiments of the present invention could include, but are not limited to:

an inverted version where the "top" door part 102*a*, i.e., the shorter part that is pushed inward is below the pivot 104 and the track 106 extends upward without a spring 108. Gravity will provide the bias force for self-closing by sliding downward. Gravity could also provide the self-closing pivoting force if the shorter door part 102*a* is weighted to be heavier than the longer part 102*b*.

the sliding pivot 104 could be braced by a vertical extension that would prevent left-right tilting of the pivot and door, note that this is accomplished by item 112. embodiments if the sliding bottom part 102*b* is constrained by the tracks 106.

the springs 108 and/or tracks 106 could be moved, shaped differently, and/or replaced by a single e.g., central spring with or without a track.

different types of springs 108 and 112 tracks 106 could extend down below the mailbox 200 bottom so that the pivot 104 could be pushed all the way down to the bottom, thereby allowing a largest package height.

other embodiment variations will probably become evident to a designer utilizing the teachings of this disclosure.

The present application, both written and drawn represent potentially different embodiments at different stages of the invention's development to date, all of which should be considered within the scope of this disclosure and any inventions described herein. The drawings may contain annotations including, for example notes, text labels, and the like. Annotations on the drawing pages should be treated as part of the written description, and have equal weight thereto. Another embodiment allows the door to pivot outward as it nears the bottom of the frame, increasing the internal space of the mailbox. Embodiments of the inventions may be made of wood, plastic, metal or other materials.

I claim:

1. A one hand closing mailbox door, including:

a frame assembly; and a door pivoting inward or outward on a horizontal pivot that is adapted to translate vertically, wherein the door allows the deposit or withdrawal of mail with one motion—wherein the frame assembly includes a track that is configured to slidably cooperate with the horizontal pivot, and wherein a spring is disposed in the track to force said door to close creating a seal.

2. The one hand closing mailbox door as in claim 1, wherein said door comprises a flexible edge or seal.

3. The one hand closing mailbox door as in claim 1, wherein the horizontal pivot further comprises a rod or pin attached to said door.

4. The one hand closing mailbox door as in claim 1, wherein said door can pivot outward near a bottom of a mailbox.

5. The one hand closing mailbox door as in claim 1, wherein a handle is mounted on said door to enable pushing said door downward.

6. The one hand closing mailbox door as in claim 1, wherein the frame assembly can be mounted on an existing mailbox.

7. The one hand closing mailbox door as in claim 1, wherein said door comprises a top part and a bottom part, and wherein the top part is slanted inward relative to the bottom part.

8. The one hand closing mailbox door as in claim 7, wherein a biasing member is disposed behind the top part and the bottom part to bias the top part outward when said door is released.

9. The one hand closing mailbox door as in claim 1, wherein said door comprises a top part and a bottom part, and wherein the top part is smaller than the bottom part.

10. The one hand closing mailbox door as in claim 1, wherein said door comprises a top part and a bottom part, wherein the bottom part is heavier than the top part such that the top part swings outward when said door is released.

11. A mailbox door assembly, comprising:

a door;

a frame assembly including a track; and a pivot, wherein the door pivots on the pivot, and wherein the pivot is adapted to translate along the track and wherein a biasing member is disposed in the track to bias the pivot toward an end of the track.

12. The mailbox door assembly of claim 11, wherein an end of the pivot is slidably disposed on the track and is configured to slide along the track to enable a linear translation of the door, and wherein the door is configured to rotate upon the pivot during the linear translation of the door.

13. The mailbox door assembly of claim 11, wherein a first part of the door is slanted inward relative to a second part of the door.

14. The mailbox door assembly of claim 11, the door further comprising a first part and a second part, wherein the second part of the door is heavier than the first part of the door such that the first part of the door swings outward when force exerted on the first part of the door is released.

15. The mailbox door assembly of claim 11, the door further comprising a first part and a second part, wherein a biasing member is disposed behind the first part and the second part, the biasing member being configured to bias the first part outward when force exerted on the first part is released.

16. The mailbox door assembly of claim 11, the door further comprising a first part and a second part, wherein the first part of the door includes a first height dimension, and wherein the second part of the door includes a second height dimension, wherein the first height dimension is less than the second height dimension.

17. A one hand closing mailbox door, including:

a frame assembly; and a door pivoting inward or outward on a horizontal pivot that is adapted to translate vertically along the frame assembly, wherein the door allows the deposit or withdrawal of mail with one motion, wherein said door comprises a top part and a bottom part, and wherein the bottom part is heavier than the top part such that the top part swings outward when said door is released.

18. A one hand closing mailbox door, including:

a frame assembly; and a door pivoting inward or outward on a horizontal pivot that is adapted to translate vertically along the frame assembly, wherein the door allows the deposit or withdrawal of mail with one motion, wherein said door comprises a top part and a bottom part, and wherein the top part is slanted inward relative to the bottom part, and wherein a biasing member is disposed behind the top part and the bottom part to bias the top part outward when said door is released.

19. A mailbox door, comprising:

a frame assembly including a track; and a pivot, wherein the door pivots on the pivot, wherein the pivot is adapted to translate along the track, the door further comprising a first part and a second part, wherein the second part of the door is heavier than the first part of the door such that the first part of the door swings outward when force exerted on the first part of the door is released.

20. A mailbox door, comprising:

a frame assembly including a track; and a pivot, wherein the door pivots on the pivot, wherein the pivot is adapted to translate along the track, the door further comprising a first part and a second part, and wherein a biasing member is disposed behind the first part and the second part, the biasing member being configured to bias the first part outward when force exerted on the first part is released.

* * * * *